US006510292B1

(12) United States Patent
Owen et al.

(10) Patent No.: US 6,510,292 B1
(45) Date of Patent: Jan. 21, 2003

(54) SYSTEM AND METHODS FOR REPORTING TONER LEVEL IN A PARTIALLY SENSED ENVIRONMENT

(75) Inventors: Kevin Owen, Meridian, ID (US); Trevor Wells, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/905,284

(22) Filed: Jul. 13, 2001

(51) Int. Cl.[7] ..... G03G 15/08
(52) U.S. Cl. ..... 399/27
(58) Field of Search ..... 399/27, 24

(56) References Cited

U.S. PATENT DOCUMENTS 5,794,094 A * 8/1998 Boockholdt et al. ..... 399/27
5,872,900 A * 2/1999 Tsuchitoi ..... 399/111
6,144,811 A * 11/2000 Ohori et al. ..... 399/9

* cited by examiner

*Primary Examiner*—Quana M. Grainger

(57) ABSTRACT

A printer system calculates toner (or other marking agent) levels in a toner cartridge over an upper portion of the cartridge, while sensing toner levels in the remaining lower portion of the cartridge. The system provides the accuracy of a sensed toner environment when it is most needed, during the latter portion of a toner cartridge lifespan. A less accurate, but useful method of calculating the toner level is employed during the earlier stages of the toner cartridge lifespan. Thus, the system avoids the high cost associated with a completely sensed toner environment while providing the increased accuracy of a sensed toner environment when it is most beneficial to the system user.

35 Claims, 5 Drawing Sheets

SYSTEM AND METHODS FOR REPORTING TONER LEVEL IN A PARTIALLY SENSED ENVIRONMENT

TECHNICAL FIELD

The present invention relates to reporting the toner level in a print device toner cartridge and, more particularly, to reporting a calculated toner level from a first portion of the toner cartridge and reporting a sensed toner level from the remaining portion of the toner cartridge.

BACKGROUND

Consumable items in printing devices mostly include "marking agent" components that are consumed with each printed page as part of the printed product, and rotating components that deteriorate over time as a result of wear and tear. Marking agent consumables include ink, wax, powder toner, thermal agents, and the like. Marking agents are often housed in some type of cartridge, such as a toner cartridge, and dispensed onto rotating components that transfer the agents to a print medium during a printing process. As a marking agent is depleted, it is useful to have information about the amount of agent remaining in a cartridge in order to approximate the number of pages available for printing during the remaining life of the cartridge. Various methods exist that provide information regarding the remaining useful life of a cartridge.

A page counting method does not involve direct measurement information about the level of toner (i.e., marking agent) present in a cartridge. Instead, this method provides an expected life span for a toner cartridge measured by the number of pages that the cartridge is expected to print. The life span is reduced by one page for each page that is printed. A disadvantage of this simple method is that it can be inaccurate.

The inaccuracy of this method can result from at least two factors. First, the expected number of pages available from a toner cartridge is a rough estimate set by the cartridge designer based on numerous examples of like cartridges. The actual number of available pages can vary significantly from cartridge to cartridge. Second, the amount of toner put on each printed page may vary dramatically from page to page. These factors often mean that more or less toner is left in a cartridge than expected, which can result in significant differences in the number of pages expected to be printed and the number of pages that can actually be printed by a given cartridge.

A pixel counting method also does not involve direct measurement information about the level of toner present in a cartridge. Rather, this method starts with an assumed maximum number of pixels available to be expended over the life of the cartridge. In a color laser printer, the number of pixels expended can be estimated by tracking the number of laser pulses used to discharge a photoconductor drum (OPC). A finite number of laser pulses is used to discharge the OPC in preparation to attract a pixel (or dot) of toner. The number of laser pulses can be measured for each printed page, and the appropriate number of pixels can be subtracted from the maximum pixels available, thereby providing a measure of the percentage of pixels (i.e., toner) remaining in the cartridge.

Unfortunately, this method suffers disadvantages similar to the previous method. The maximum number of available pixels is assumed by the cartridge designer based on numerous examples of like cartridges. The actual number of available pixels can vary significantly from cartridge to cartridge. In addition, counting laser pulses can be an inaccurate method of determining the number of expended pixels on a printed page. Although the error per page may be slight, it can add up over the life of the cartridge (e.g., 10,000 printed pages) and create a significant difference in the expected percentage of toner available and the actual percentage of toner available. Moreover, the largest errors are seen toward the end of the cartridge life cycle, which is the time when it is most important to have accurate toner level information.

Another method of determining the toner level within a cartridge utilizes antenna sensor technology. This method provides direct information about the level of toner in a cartridge and is therefore more accurate than the previously discussed methods. The level of toner in a cartridge is determined by passing current from one end of the cartridge to the other through an antenna. The current induces voltage signals in coils within the cartridge that are proportional to the amount of toner present in the cartridge. Although this direct measurement of the toner level is beneficial, it too has disadvantages.

One disadvantage of using antenna sensor technology is its cost. Where page counting and pixel counting methods can be implemented by simple software executing on pre-existing computer hardware, the antenna technology requires the installation of hardware into each toner cartridge. In addition to the cost of the antenna hardware itself, there are design costs associated with fitting the hardware inside different cartridges of varying shapes and sizes. Moreover, the physical size constraints of some cartridges prohibit antenna sensor coverage throughout the entire cartridge, thus limiting toner level sensing to only part of the cartridge.

Accordingly, the need exists for a cost effective way to determine the level of toner present throughout the life of a toner cartridge in a manner that permits a high level of predictability as to the remaining useful life of the toner cartridge.

SUMMARY

A printer system calculates toner (or other marking agent) levels in a toner cartridge over an upper portion of the cartridge, while sensing toner levels in the remaining lower portion of the cartridge. The system provides the accuracy of a sensed toner environment when it is most needed (i.e., during the latter portion of a toner cartridge lifespan). A less accurate, but useful method of calculating the toner level is employed during the earlier stages of the toner cartridge lifespan. Thus, the system avoids the high cost associated with a fully sensed toner environment while providing the increased accuracy of a sensed toner environment when it is most beneficial to the system user.

Early in the lifespan of a toner cartridge, the system reports toner levels using a counting method. The method calculates toner levels based on the estimated availability and usage of page capacity or pixel capacity for the cartridge. Therefore, the calculations provide an estimated toner level for the system to report.

In addition, the system monitors readings from a partial sensor configured to sense toner levels in the lower portion of the toner cartridge. While the actual toner level remains above the upper threshold of the lower/sensed portion of the cartridge, the sensor readings generally indicate that the toner level is at 100% of the lower portion of the cartridge.

Thus, the sensor readings become meaningful only when the actual toner level drops below the upper threshold of the sensed portion of the cartridge.

Because the estimated toner level is less accurate than the sensed toner level, the system switches from reporting the estimated toner level to reporting the sensed toner level at the first indication that the sensor is in play. That is, at the first indication that the sensor readings are meaningful, the system begins reporting toner levels based on the sensor readings.

There are three indications that prompt the system to switch from reporting the estimated toner level to reporting the sensed toner level. The first is when the estimated toner level drops below the threshold level of the lower portion of the cartridge, and the sensed toner level remains at the threshold. The second is when the estimated toner level remains above the threshold, and the sensed toner level drops below the threshold. The last indication, which is unlikely based on the inherent inaccuracy of the counting method, is when both the estimated and sensed toner levels drop below the threshold at the same time. Under each of these circumstances, the system begins reporting the sensed toner level.

The system continues reporting the sensed toner level throughout the remaining lifespan of the cartridge, providing a user with the more accurate toner level information when it is most useful.

BRIEF DESCRIPTION OF THE DRAWINGS

The same reference numbers are used throughout the drawings to reference like components and features.

DETAILED DESCRIPTION

The system and methods described herein relate to reporting the supply level of a marking agent (e.g., toner) in a print device cartridge. A counting method is employed to calculate an estimated level of toner in a toner cartridge over a portion of the useful life of the cartridge. During this period, the system uses the estimated level as the reported toner supply level. A sensor device is used to determine the reported toner supply level during the latter portion of the useful life of the cartridge. Costs associated with a fully sensed toner environment are avoided while the accuracy of toner level reporting is maintained during the time when accuracy is most beneficial.

Figure 1:
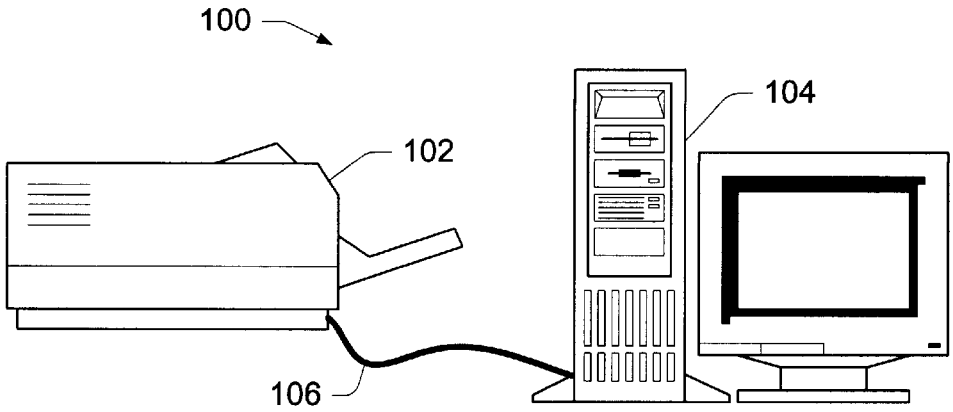
FIG. 1 illustrates a workstation and printing device as a suitable system environment in which to report toner levels from a partially sensed environment.

Exemplary System for Reporting Toner Levels in a Partially Sensed Environment FIG. 1 illustrates an example of a printing system that is suitable for reporting toner levels in a partially sensed environment. The system 100 of FIG. 1 includes a printer device 102 connected to a host computer 104 through a direct or network connection 106. Network connections 106 can include LANs (local area networks), WANs (wide area networks), or any other suitable communication link. The invention is applicable to various types of printing devices that make use of marking agent consumables such as ink, wax, powder toner, thermal agents, and the like. Therefore, printer device 102 can include devices such as copiers, fax machines and scanners, and may also include multifunction peripheral (MFP) devices which combine the functionality of two or more peripheral devices into a single device.

In general, the host computer 104 outputs host data to the printer device 102 in a driver format suitable for the device 102, such as PCL or postscript. The printer device 102 converts the host data and outputs it onto an appropriate recording media, such as paper or transparencies.

Figure 2:
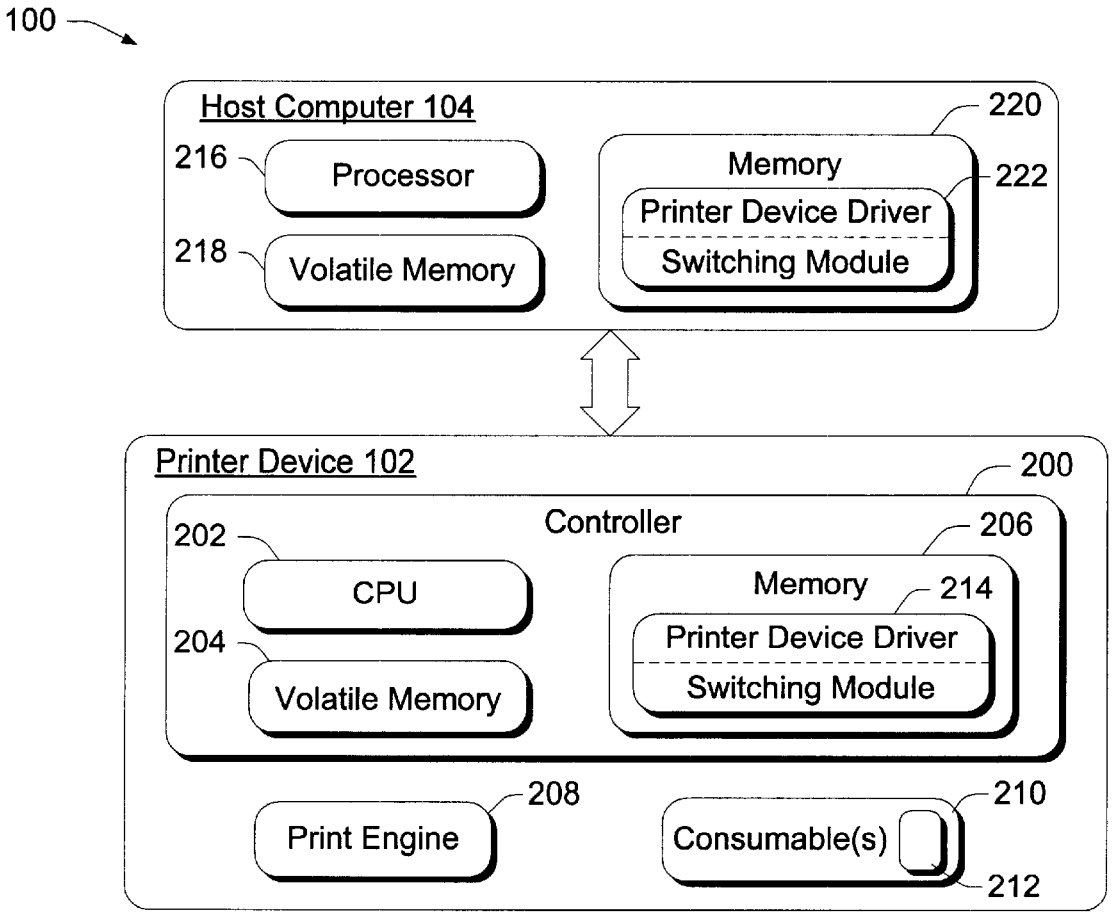
FIG. 2 is a block diagram illustrating a system such as that in FIG. 1.

FIG. 2 illustrates the printer system 100 in more detail. The printer device 102 has a controller 200 that processes the host data. The controller 200 typically includes a data processing unit or CPU 202, a volatile memory 204 (i.e., RAM), and a non-volatile memory 206 (e.g., ROM, Flash). Printer device 102 includes a print engine 208 and one or more consumable printing components 210. Consumable(s) 210 represent marking agents typically housed in cartridges whose supply levels decrease with each printed page output by print device 102. Therefore, consumable(s) 210 generally include cartridges and other containers that hold ink, wax, powder toner, thermal agents, and the like. Other typical print device consumables such as paper, photoconductors, transfer drums or belts, and fusers are not illustrated in FIG. 2, but are discussed below with reference to FIG. 3.

Consumable(s) 210 include monitoring devices 212 that are configured to sense toner (i.e., marking agent) supply levels within a limited portion of a consumable 210. The monitoring devices 212 are typically located within the consumable 210 itself. Instead of sensing toner supply levels throughout the entire consumable 210, the monitoring devices 212 are only capable of sensing toner levels in the bottom portion of the consumable 210. Monitoring devices 212 are therefore toner level sensors that are implemented within a consumable 210 (e.g., a toner cartridge) to a lesser than full degree, such that they provide a partially sensed toner environment rather than a fully sensed toner environment.

Monitoring devices 212 are preferably antenna sensor devices that measure supply levels within a cartridge by passing current through a partial plate capacitor antenna within the cartridge. The current induces voltage signals in coils within the cartridge that are proportional to the amount of toner present in the cartridge. Monitoring devices 212 can include any toner level sensor 212 that provides a partially sensed toner environment by virtue of its partial implementation within a toner cartridge (i.e., consumable 210).

The printer controller 200 processes host data and manages the print process by controlling the print engine 208 and consumable(s) 210. Printer controller 200 includes printer driver software 214 executing on CPU(s) 202. The printer driver software 214 is stored in memory 206 and controls toner level reports provided by the system 100. The printer driver software 214 includes a switching module that executes to control whether the system 100 reports an estimated toner level or a sensed toner level.

An estimated toner level is calculated by the printer driver software 214 based on a counting method that uses the estimated availability and usage of toner capacity within a toner cartridge. Counting methods include pixel and page counting methods, with the pixel counting method being preferred. A pixel counting method begins with an estimated pixel capacity for a toner cartridge and reduces that capacity with each expended pixel. The percent of pixel capacity remaining is equated to a percent of toner remaining in the cartridge to provide an estimated toner level. Likewise, a page counting method begins with an estimated page capacity for a toner cartridge and reduces that capacity with each printed page. The percent of page capacity remaining is equated to a percent of toner remaining in the cartridge to provide an estimated toner level.

In addition to calculating an estimated toner level, the printer driver software 214 continually monitors a sensed toner level from a toner level sensor 212 (monitor device 212) as described above. Based on a method described herein below, the switching module portion of software 214 determines when the system 100 reports the estimated toner level and when the system 100 switches over to report the sensed toner level.

Toner level reports can be output on print device 102, the host computer 104, or any suitable display device coupled to print device 102. Although the printer driver software 214 and switching module generally execute on print device 102, they may also be stored and execute on the host computer 104 as illustrated by printer driver 222.

The host computer 104 includes a processor 216, a volatile memory 218 (i.e., RAM), and a non-volatile memory 220 (e.g., ROM, hard disk, floppy disk, CD-ROM, etc.). The host computer 104 may be implemented, for example, as a general-purpose computer, such as a desktop personal computer, a laptop, a server, and the like. The host computer 104 may implement one or more software-based printer drivers 222 that are stored in non-volatile memory 220 and executed on the processor 216 to configure data into an appropriate format (e.g., PCL, postscript, etc.) and output the formatted data to the printer device 102.

Figure 3:
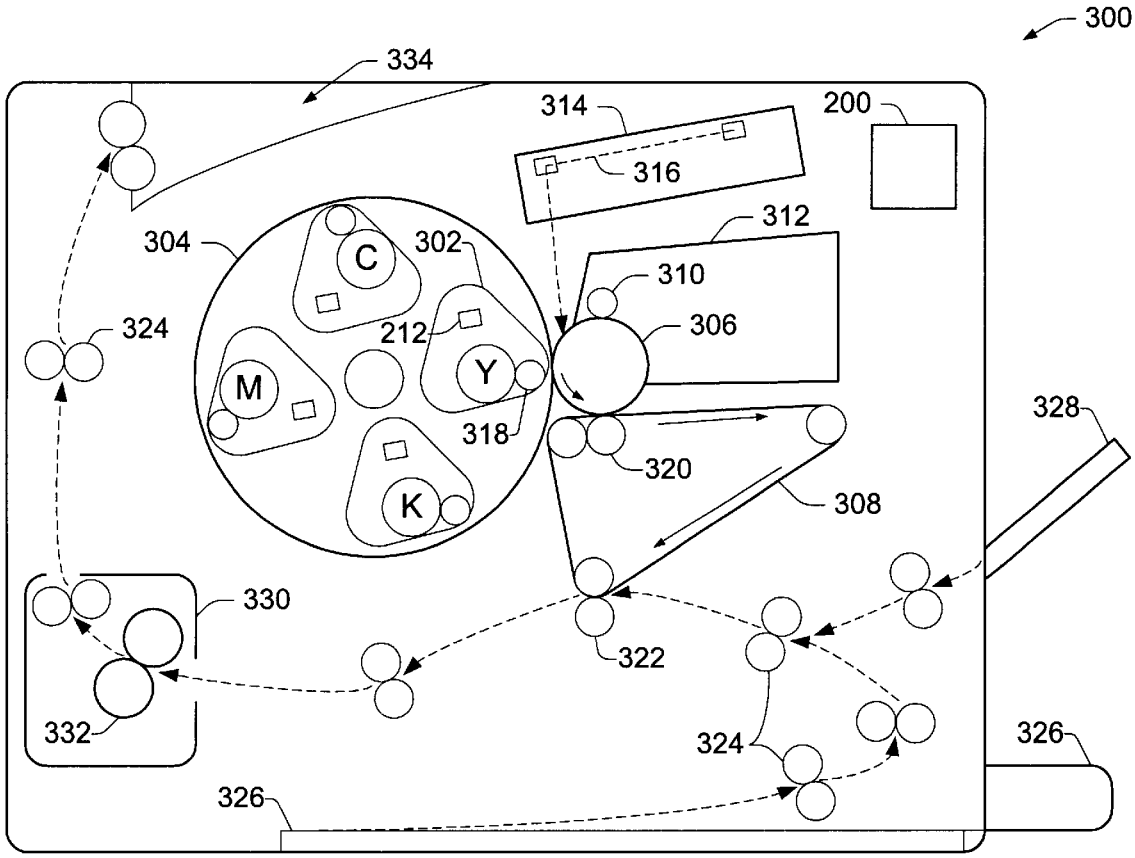
FIG. 3 illustrates a printer device which uses a number of toner cartridges and various other consumable components.

Exemplary Print Process for Reporting Toner Levels in a Partially Sensed Environment FIG. 3 represents a color laser printer 300 as an example print device 102 that may be used in the printing system 100 of FIGS. 1 and 2. A general printing process will now be described with respect to color laser printer 300 for the purpose of illustrating a context for reporting toner levels in a partially sensed toner (i.e., marking agent) environment.

A typical color laser printer 300 produces an image using various colored toners. During an imaging process, a four color image is built sequentially onto a transfer element, such as an intermediate transfer belt 308, before it is finally transferred to the print medium (e.g., paper or transparency) in one pass. The ultimate application of the toners to the print medium is controlled by an electrostatic imaging process.

Color printer 300 houses four toner cartridges 302 in a rotating carousel 304 that is operational with a photoconductor (OPC) drum 306. Toner cartridges 302 contain the four main toner colors cyan (C), magenta (M), yellow (Y), and black (K). Although the toner cartridges 302 are illustrated as separate devices inserted into rotating carousel 304, they may additionally be implemented as a single all-in-one color cartridge that includes the four toner colors. For example, the rotating carousel 304 may represent a single all-in-one color cartridge, while toner cartridges 302 represent separate housings within the all-in-one cartridge for accommodating the four color toners. In addition, OPC drum 306 may be implemented as one or more OPC drums. For example, there may be four OPC drums 306, one to accommodate the transfer of each color toner.

To begin the imaging process, a primary charge roller 310 within the OPC drum assembly 312 applies an electrostatic charge to the OPC drum 306. As the OPC drum 306 rotates, a laser assembly 314 writes the latent image for the first color onto the drum 306 with laser 316. The toner carousel 304 then puts the first color toner cartridge 302 into position for operation with the OPC drum 306. Within toner cartridge 302, an agitator (not shown) guides toner to a developer roller 318. As the developer roller 318 and OPC drum 306 rotate, the toner is developed to the latent image electrostatically formed on the OPC drum 306.

Each color image is thus developed one at a time on the OPC drum 306. Also, each color image is transferred one at a time to the rotating intermediate transfer belt (ITB) 308 because of attraction from electric charge on primary transfer roller 320. Once the four-color image has been built on the ITB 308, the secondary transfer roller 322 is activated to attract the image away from the ITB 308 and onto the paper in one pass of the ITB 308 over the paper. The paper is guided by guide rollers 324 from a paper tray 326 or external source 328 past the ITB 308 and then through the fuser assembly 330. The fuser assembly 330 includes two hot rubber fuser rollers 332 that melt the toner, bonding it to the paper. From the fuser assembly 330, the paper exits the printer 300 into the output tray 334.

With each page printed by the color laser printer 300, supply levels within toner cartridges 302 decrease. Printer driver software 214 (FIG. 2) executing on printer controller 200, calculates estimated toner levels and monitors sensed toner levels from monitoring devices 212. The printer controller 200 uses the estimated and sensed toner level information to create toner level reports that indicate the percentage of toner or other marking agent remaining in the cartridges 302. The printing system 100 (FIGS. 1 and 2) typically presents toner level reports through a display on printer 300 or a display on host computer 104 upon request from a system user. Toner level reports can also be presented automatically on preset intervals, such as time based intervals or event based intervals. An event based interval can include events such as the periodic printing of a certain number of pages, the periodic decrease in reported toner level by a certain percent, or reaching a certain minimum reported toner level.

Exemplary Method for Reporting Toner Levels in a Partially Sensed Environment

An example method for determining and reporting toner levels from a partially sensed environment will now be described with primary reference to FIGS. 4, 5, and 6.

Figure 4:
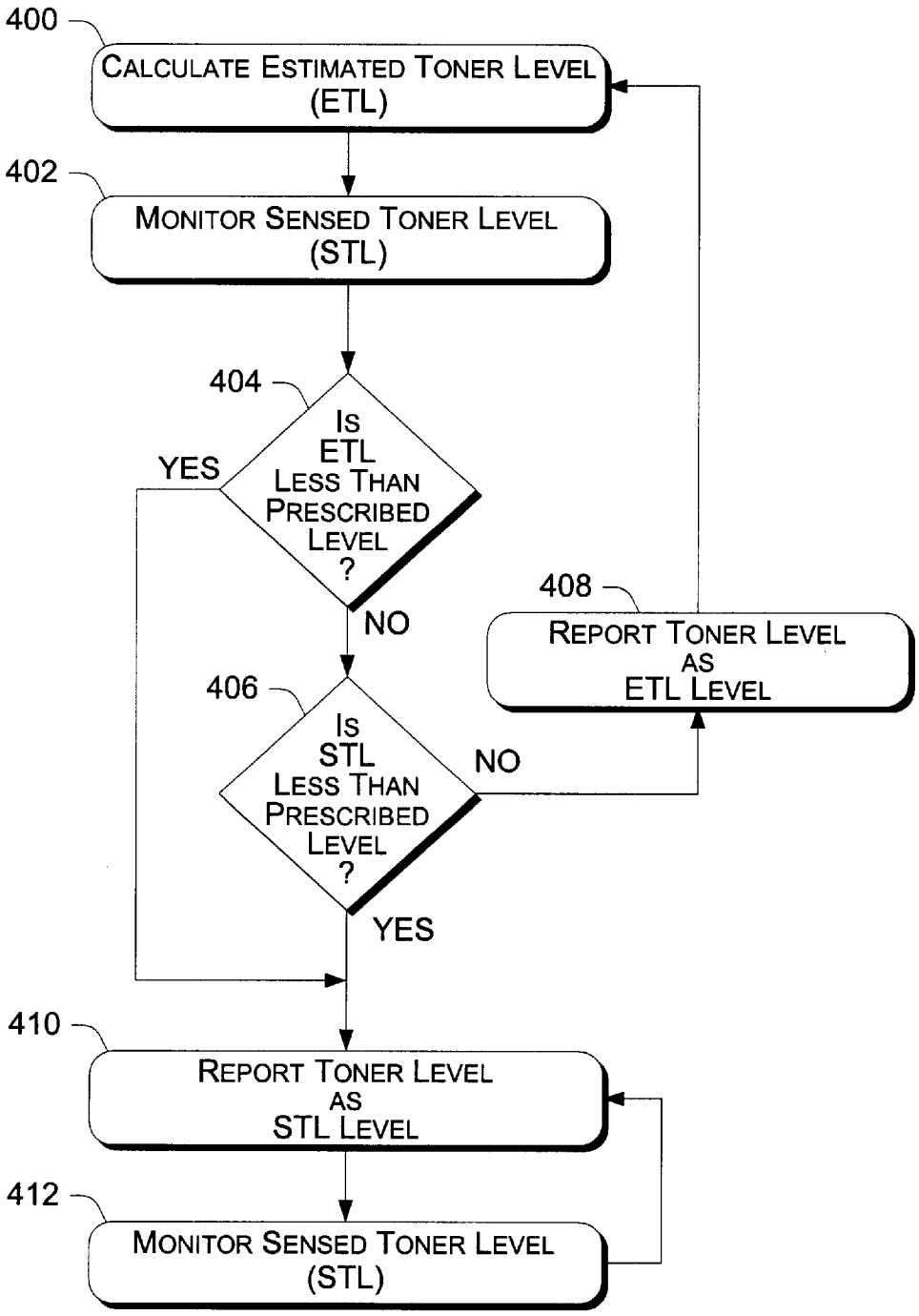
FIG. 4 is a flow diagram illustrating an example method of determining a reported toner level throughout the life of a toner cartridge.

FIG. 4 is a flow diagram illustrating an example of a general method for determining and reporting toner levels from the partially sensed toner environment of a consumable 210. Operations included in the method of FIG. 4 are ideally performed in a system 100 such as that shown in FIGS. 1 and 2, and are typically implemented on either a print device 102 or a host computer 104. However, the method operations of FIG. 4 are not limited to being performed on a single device, but can also be performed alternately between devices such as print device 102 and host computer 104.

Figure 5:
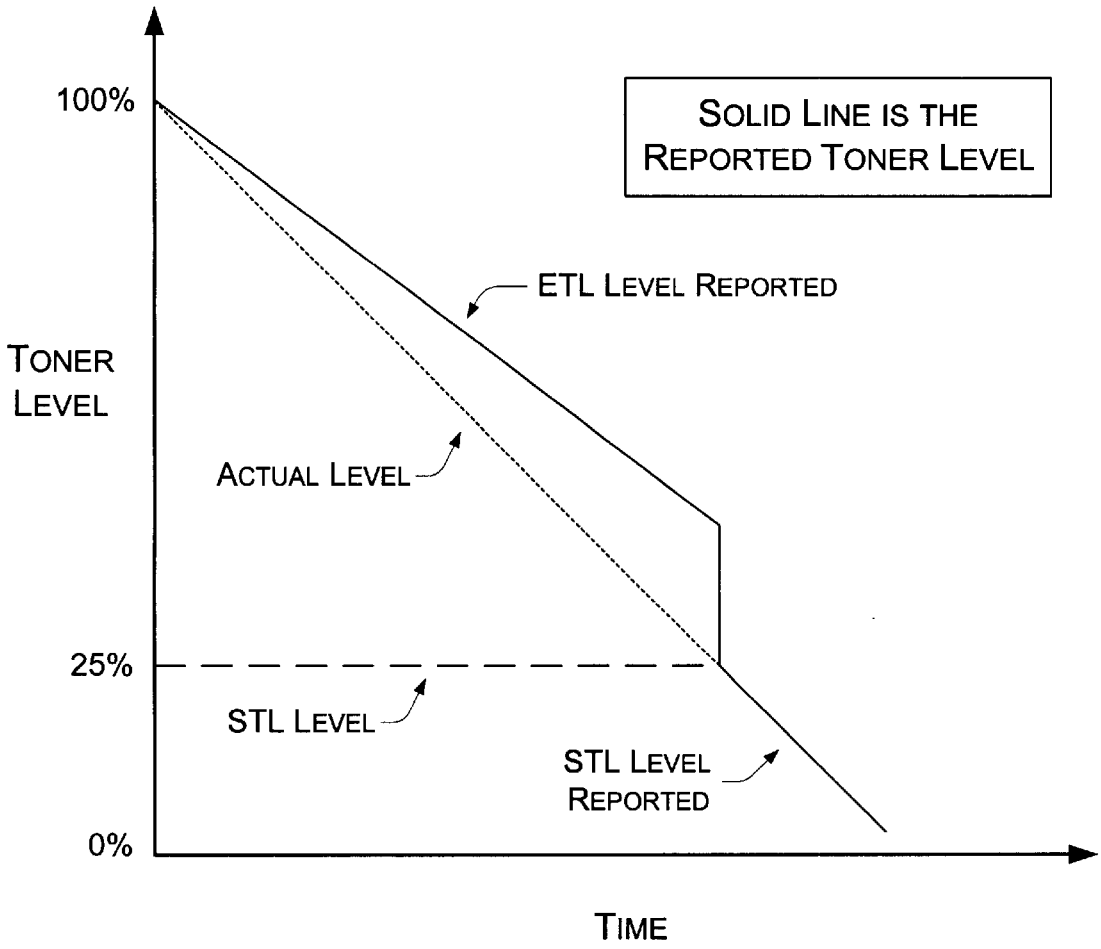
FIG. 5 is a plot of percent of toner versus time throughout the life of a toner cartridge illustrating when the reported toner level changes from a calculated level to a sensed level.
Figure 6:
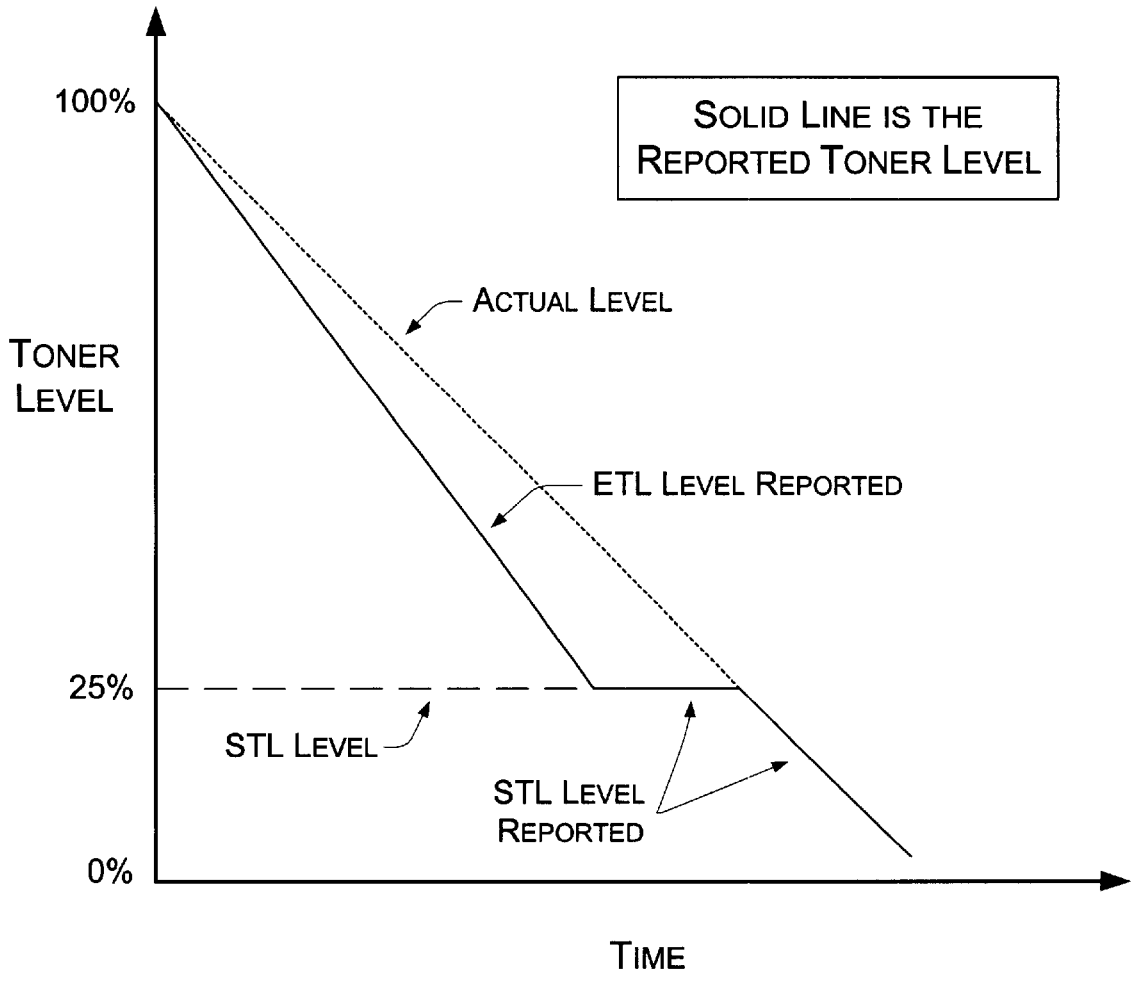
FIG. 6 is a plot of percent of toner versus time throughout the life of a toner cartridge illustrating when the reported toner level changes from a calculated level to a sensed level.

FIGS. 5 and 6 are plots showing toner level versus time throughout the useful life of a toner cartridge. The plots illustrate when the system 100 reports an estimated (calculated) toner level and when the system reports a sensed toner level. The plots also illustrate two different scenarios in which the system 100 switches from reporting an estimated (calculated) toner level to reporting a sensed toner level. The two plots facilitate the following description of the method of FIG. 4.

The example method of FIG. 4 begins at operation 400 with calculating an estimated toner level. As previously discussed, estimated toner levels are determined by calculations performed in a counting method, such as a page counting method or a pixel counting method. The method continues with monitoring a sensed toner level at operation 402. The sensed toner level is provided by a toner level sensor 212 (monitoring device), also discussed above. Although the flow diagram of FIG. 4 indicates that the monitoring operation 402 occurs after the calculating operation 400, the operations can occur in any order, and typically occur concurrently. The frequency of the operations can be based on a preset time interval, but is preferably based on an event such as the printing of a page or a change in the sensed toner level, or both. Thus, in accordance with the remaining method operations described below, each time a page is printed or the sensed toner level changes, the reported toner level is updated.

The method continues at operation 404 with comparing the estimated toner level (ETL) to a prescribed level. If the ETL is not less than the prescribed level, then the method proceeds with operation 406, where the sensed toner level (STL) is compared to the prescribed level. Operations 404 and 406, in conjunction with operation 408, illustrate that as long as both the ETL and STL (i.e., the estimated and sensed toner levels) are not less than the prescribed level, then the ETL (estimated toner level) is used as the reported toner level for the system 100.

However, operations 404 and 406, in conjunction with operation 410, illustrate that if either the ETL or the STL (i.e., the estimated or sensed toner level) drops below the prescribed level, then the system 100 switches to the STL (sensed toner level) as the reported toner level. Once either the ETL or the STL drops below the prescribed level, the system 100 only relies on the sensed toner level for reporting, as illustrated by repeating operations 410 and 412.

The prescribed level used for comparison is the maximum level that a toner level sensor 212 can monitor within a toner cartridge (consumable 210). That is, the prescribed level is the 100% level of the partially sensed toner environment within the toner cartridge. Note that this level can be any level for which a toner level sensor 212 is designed as a partial sensor in a cartridge. Therefore, if the toner level sensor 212 is designed to monitor the last 25% of the toner cartridge, then the prescribed level is 25%.

FIGS. 5 and 6 illustrate the ongoing method of FIG. 4. Both FIGS. 5 and 6 assume a toner level sensor 212 designed to monitor 25% of the toner environment within a toner cartridge (consumable 210). The solid lines plotted in both FIGS. 5 and 6 illustrate the toner level that is reported by the system 100. The solid lines show where the reported toner level changes from the ETL (estimated toner level) to the STL (sensed toner level). The dotted lines represent the actual toner level within the toner cartridge, and the dashed lines represent the sensed toner levels (STL).

The plots of FIGS. 5 and 6 show that the estimated toner level (ETL) is the level that is reported by the system 100 throughout most of the lifespan of the toner cartridge. However, when either the estimated toner level (ETL) or the sensed toner level (STL) drops below the prescribed level of 25%, the system 100 begins using the sensed toner level (STL) as its reported toner level.

FIG. 5 specifically illustrates a scenario in which the estimated toner level (ETL) indicates a level that is higher than the actual toner level in the cartridge. Under this scenario, the sensed toner level (STL) will indicate that the actual level has dropped below 25% (the prescribed level) before the ETL provides such an indication. Upon this indication from the STL, because it is known that the STL is more accurate than the ETL, the system 100 switches from reporting the ETL to reporting the more accurate STL.

FIG. 6 specifically illustrates a scenario in which the estimated toner level (ETL) indicates a level that is lower than the actual toner level in the cartridge. Under this scenario, the estimated toner level (ETL) will indicate that the actual level has dropped below 25% (the prescribed level) before the STL provides such an indication. Upon this indication from the ETL, because it is known that the STL is more accurate than the ETL, the system 100 switches from reporting the ETL to reporting the more accurate STL.

Under another unlikely scenario, the estimated toner level (ETL) could be uncharacteristically accurate to the extent that both the ETL and STL drop below the prescribed 25% level at the same time. Under such a scenario, the system 100 would switch from reporting the ETL to reporting the more accurate STL.

Although the description above uses language that is specific to structural features and/or methodological acts, it is to be understood that the invention defined in the appended claims is not limited to the specific features or acts described. Rather, the specific features and acts are disclosed as exemplary forms of implementing the invention.

What is claimed is:

1. A method comprising:

calculating an estimated toner level in a toner cartridge;

monitoring only a lower portion of the toner cartridge for a sensed toner level;

reporting the estimated toner level during initial use of the toner cartridge; and reporting the sensed toner level during later use of the toner cartridge.

2. A method as recited in claim 1, wherein:

the initial use of the toner cartridge is when the estimated toner level remains at or above a prescribed level and the sensed toner level remains at the prescribed level; and the later use of the toner cartridge is after the sensed toner level or the estimated toner level drops below the prescribed level.

3. A method as recited in claim 2, further comprising:

defining the prescribed level as a highest point in the lower portion of the toner cartridge, such that a maximum sensed toner level is the prescribed level.

4. A method comprising:

calculating an estimated toner level in a toner cartridge;

monitoring a lower portion of the toner cartridge for a sensed toner level;

reporting the estimated toner level during initial use of the toner cartridge;

reporting the sensed toner level during later use of the toner cartridge; and ceasing the calculating an estimated toner level during the later use of the toner cartridge.

5. A method as recited in claim 1, wherein the calculating an estimated toner level further comprises:

estimating a page capacity for the toner cartridge;

reducing the page capacity each time a page is printed using the toner cartridge; and equating the estimated toner level to the percentage of remaining page capacity.

6. A method as recited in claim 1, wherein the calculating an estimated toner level further comprises:

estimating a pixel capacity for the toner cartridge;

reducing the pixel capacity by a number of pixels each time a page is printed using the toner cartridge; and equating the estimated toner level to the percentage of remaining pixel capacity.

7. A method as recited in claim 1, wherein the monitoring further comprises:

receiving a sensed toner level reading from a toner level sensor.

8. A method as recited in claim 1, wherein the calculating occurs at a preset interval.

9. A method as recited in claim 8, wherein the preset interval is one of a temporal interval or an event-based interval.

10. A method as recited in claim 1, wherein the reporting occurs upon a user request.

11. A method as recited in claim 1, wherein the reporting occurs automatically at a preset interval.

12. A method as recited in claim 11, wherein the preset interval is one of a temporal interval or an event-based interval.

13. A print device, having computer-readable media with computer-readable instructions for performing the method as recited in claim 1.

14. A computer, having computer-readable media with computer-readable instructions for performing the method as recited in claim 1.

15. In a printing system having a marking agent consumable, a method comprising:

calculating an estimated level of marking agent;

monitoring a sensed level of marking agent only in a lower portion of the consumable;

reporting the estimated level during initial use of the consumable; and reporting the sensed level during later use of the consumable.

16. A method as recited in claim 15, wherein:

the initial use of the consumable is when the estimated level remains at or above a prescribed level and the sensed level remains at the prescribed level; and the later use of the consumable is after the sensed level or the estimated level drops below the prescribed level.

17. In a printing system having a marking agent consumable, a method comprising:

calculating an estimated level of marking agent;

monitoring a sensed level of marking agent, wherein the monitoring occurs only in a lower portion of the consumable;

reporting the estimated level during initial use of the consumable, wherein the initial use of the consumable is when the estimated level remains at or above a prescribed level and the sensed level remains at the prescribed level, and wherein the prescribed level is equal to the maximum level of the lower portion of the consumable; and reporting the sensed level during later use of the consumable, wherein the later use of the consumable is after the sensed level or the estimated level drops below the prescribed level.

18. In a printing system having a marking agent consumable, a method comprising:

estimating consumable usage during initial use of the consumable; and directly sensing consumable usage only in a lower portion of the consumable during later use of the consumable.

19. A method as recited in claim 18, further comprising:

reporting an estimated level of marking agent during the initial use of the consumable; and reporting a sensed level of marking agent during the later use of the consumable.

20. A method as recited in claim 19, wherein:

the initial use of the consumable is when the estimated level remains at or above a prescribed level and the sensed level remains at the prescribed level; and the later use of the consumable is after the sensed level or the estimated level drops below the prescribed level.

21. A method as recited in claim 20, further comprising:

defining the prescribed level as a highest point in a lower portion of the consumable, such that a maximum sensed level is the prescribed level.

22. A printer comprising:

a consumable marking agent;

a sensor to monitor only a lower portion of a consumable marking agent container and to provide a sensed level of the consumable marking agent;

a printer controller configured to calculate an estimated level of the consumable marking agent;

the printer controller further configured to report the estimated level during initial use of the consumable marking agent and to report the sensed level during later use of the consumable marking agent.

23. A printer as recited in claim 22, wherein:

the initial use of the consumable marking agent is when the amount of marking agent exceeds a prescribed level; and the later use of the consumable marking agent is after the amount of marking agent no longer exceeds the prescribed level.

24. A printer as recited in claim 23, further comprising:

a marking agent container for holding the consumable marking agent; and wherein the sensor is a partial sensor that monitors a lower portion of the marking agent container.

25. A printer as recited in claim 24, wherein the prescribed level is equal to a maximum level of the lower portion of the marking agent container.

26. A computer coupled to a print device, the print device comprising a consumable marking agent and a sensor to provide a sensed level of the marking agent, the computer comprising:

a printer controller configured to calculate an estimated level of the marking agent;

the printer controller further configured to report the estimated level while the amount of marking agent exceeds a prescribed level and to report the sensed level only when the amount of marking agent no longer exceeds the prescribed level.

27. A system comprising:

a marking agent;

a sensor to monitor only a lower portion of a marking agent container and to provide a sensed level of the marking agent;

a controller configured to calculate an estimated level of the marking agent;

the controller further configured to report the estimated level while the amount of marking agent exceeds a prescribed level and to report the sensed level once the amount of marking agent no longer exceeds the prescribed level.

28. A system as recited in claim 27, wherein the controller is a printer controller located on a print device.

29. A system as recited in claim 27, wherein the controller is a printer controller located on a host computer.

30. A system as recited in claim 27, further comprising:

a marking agent container for holding the marking agent; and wherein the sensor is a partial sensor that monitors a lower portion of the marking agent container.

31. A system as recited in claim 30, wherein the prescribed level is equal to a maximum level of the lower portion of the marking agent container.

32. A computer-readable medium comprising computer-executable instructions configured for:

calculating an estimated toner level in a toner cartridge;

monitoring only a lower portion of the toner cartridge for a sensed toner level;

reporting the estimated toner level during initial use of the toner cartridge; and reporting the sensed toner level during later use of the toner cartridge.

33. A computer-readable medium as recited in claim 32, wherein:

the initial use of the toner cartridge is when the estimated toner level remains at or above a prescribed level and the sensed toner level remains at the prescribed level; and the later use of the toner cartridge is after the sensed toner level or the estimated toner level drops below the prescribed level.

34. A computer-readable medium as recited in claim 33, comprising further computer-executable instructions configured for defining the prescribed level as a highest point in the lower portion of the toner cartridge, such that a maximum sensed toner level is the prescribed level.

35. A computer-readable medium comprising computer-executable instructions configured for:

calculating an estimated toner level in a toner cartridge;.

monitoring a lower portion of the toner cartridge for a sensed toner level;

reporting the estimated toner level during initial use of the toner cartridge;

reporting the sensed toner level during later use of the toner cartridge; and ceasing the calculating an estimated toner level during the later use of the toner cartridge.

* * * * *